United States Patent [19]

Unuma et al.

[11] Patent Number: 5,048,739

[45] Date of Patent: Sep. 17, 1991

[54] INTEGRAL FRAME TYPE PAPER FEEDER

[75] Inventors: Sadao Unuma, Oobu; Koichi Hara, Chita, both of Japan

[73] Assignee: Tokai Kogyo Kabushiki Kaisha, Oobu, Japan

[21] Appl. No.: 615,854

[22] Filed: Nov. 20, 1990

[30] Foreign Application Priority Data

Nov. 30, 1989 [JP] Japan ..... 1-312017

[51] Int. Cl.[5] ..... B65H 20/20

[52] U.S. Cl. ..... 226/74; 400/616.1

[58] Field of Search ..... 226/74, 75; 400/616.1, 400/616.2, 613.3

[56] References Cited

U.S. PATENT DOCUMENTS

| | | | |
|---|---|---|---|
| 2,179,156 | 11/1939 | Mabon | 226/75 |
| 4,194,660 | 3/1980 | Seitz | 226/74 |
| 4,697,727 | 10/1987 | Hubbard, II | 226/74 |
| 4,723,697 | 2/1988 | Tano et al. | 226/74 |
| 4,826,337 | 5/1989 | Unuma | 226/74 X |

*Primary Examiner*—Daniel P. Stodola
*Assistant Examiner*—P. Bowen
*Attorney, Agent, or Firm*—Wenderoth, Lind & Ponack

[57] ABSTRACT

An integral frame type paper feeder in which perforated paper is fed by a pin-carrying feed belt set in a main frame by a driving sprocket. The paper feeder has a pair of sub-frames for assembling the feed belt and driving sprocket in a sub-assembly, and a main frame consisting of a pair of opposed side plates spaced from each other at a predetermined distance, and to which the sub-frames are fixed, and an upper plate the upper surface of which constitutes a paper feed surface. The upper plate has a feed belt moving bore which extends in the direction in which the perforated paper is fed, and which causes the portion of the feed belt on which the perforated paper is being fed to be aligned with the paper feed surface. The two sub-frames, and the feed belt and the driving sprocket are combined with the sub-frames into a driving assembly, and this is fitted between the side plates of the main frame.

2 Claims, 10 Drawing Sheets

INTEGRAL FRAME TYPE PAPER FEEDER

BACKGROUND OF THE INVENTION

1. Field of the Invention

This invention relates to a paper feeder constructed so as to feed perforated paper, the perforations in which are fitted over the feed pins of a feed belt, by moving this feed belt by a driving sprocket, and more particularly to an integral frame type paper feeder having a main frame formed integrally so as to improve the rigidity thereof, whereby the paper feed accuracy is heightened.

2. Description of the Prior Art

A main frame of a paper feeder houses therein a driving assembly consisting of a feed belt, and a driving sprocket used to drive this feed belt.

The main frame of a conventional paper feeder is formed by combining a plurality of parts by a connecting means as shown in, for example, FIG. 21, which illustrates two frame members 51, 52 constituting side plates and combined with each other by a connecting bolt 53. Therefore, this main frame has the following various kinds of inconveniences.

(1) The main frame is formed by combining a plurality of parts, and each part necessarily has assembly tolerance. Accordingly, the accuracy and rigidity of the main frame decrease due to the part assembling work.

(2) When the two frame members 51, 52 are combined with each other in a dislocated state as shown in FIGS. 22 and 23, a difference occurs between paper feed clearances C, C' defined by the upper surfaces of the frame members 51, 52 and the opposed surface of a cover member 54, so that the paper feed accuracy lowers.

(3) The clearance of a slide portion of a feed belt 55 is determined on the basis of the main frame assembling accuracy. Accordingly, when this clearance is small, the feed belt 55 is clamped by the frame members 51, 52 to cause the rotary torque, which is necessary for moving the feed belt 55, of a driving sprocket 56 to increase. When this clearance is large, the feed belt 55 becomes loose while in motion, to cause the paper feed accuracy to lower.

(4) The side plates consisting of the frame members 51, 52 which constitute the main frame are provided therein with bores 57 for supporting the driving sprocket 56, and bores 58 for receiving a support shaft. If the axes of the bores 57 for supporting the driving sprockets 56 become out of alignment with each other due to the decrease in the main frame assembling accuracy, the rotational resistance of the driving sprocket 56 becomes high, so that the torque required to rotate the same sprocket increases. Similarly, if the axes of the bores 58 for receiving the support shaft therein become out of alignment with each other, the paper clamping effect of the paper feeder decreases to an unsatisfactory level, and troubles occur when the paper feeder is moved laterally along the support shaft. Moreover, the paper feeder inclines when the paper is clamped.

(5) Since the main frame is formed by combining a plurality of parts with one another, it necessarily incurs frame assembling cost, so that the cost of manufacturing the main frame increases as compared with that of an integrally formed main frame. In addition, the number of parts of the main frame increases, and the part manufacturing cost and the control expenses for the parts also increase.

Therefore, it is an object of the present invention to provide a paper feeder in which a main frame is formed integrally to improve both the rigidity of the main frame and the assembling accuracy of the paper feeder, whereby the paper feed accuracy of the paper feeder is improved to eliminate the above-mentioned inconveniences of the main frame of a part-assembly structure completely.

SUMMARY OF THE INVENTION

The paper feeder according to the present invention constructed so that perforated paper is fed by moving a feed belt, which is set in a main frame, by a driving sprocket with feed pins on the feed belt fitted in the perforations in the perforated paper, and characterized in that the paper feeder has a pair of sub-frames for use in assembling the feed belt and driving sprocket with each other in the form of a sub-assembly, and a main frame of an integral structure consisting of a pair of side plates which are formed in an opposed state at both side portions thereof so as to be spaced from each other at a predetermined distance, and which are used to fix the sub-frames thereto, and an upper plate the upper surface of which constitutes a paper feed surface, which upper plate is provided with a feed belt moving bore which is formed so as to extend in the direction in which the perforated paper is fed, and which allows the portion of the feed belt on which the perforated paper is being fed to be aligned with the paper feed surface; a driving assembly, which consists of the two sub-frames, the feed belt and driving sprocket, which are combined with the sub-frames, being fitted between the side plates of the main frame, the sub-frames being fixed to the side plates.

In the paper feeder according to the present invention, a driving assembly consisting of a feed belt and a driving sprocket which are attached to a pair of sub-frames is thus set between side plates of an integrally formed main frame. Therefore, the rigidity of the frame becomes high, and the positional relation between the side plates does not change during the assembling of the paper feeder or the practical use thereof. This enables the accuracy of the construction of the paper feeder to be improved.

Since the main frame has an integral construction, the positions of the side plates do not change relatively to each other, so that the paper feed clearance formed between the paper feed surface constituting the upper surface of the main frame and the opposed surface of the over member becomes invariable. The paper feed surface constituting the upper surface of the main frame is provided with a feed belt moving bore, the width of which is invariable, so that the tight holding of the feed belt between the side plates or the loosening of the feed belt does not occur. This enables the paper feed accuracy to be improved.

Since the main frame has an integral construction, the construction of the paper feeder becomes simple, and the number of the parts constituting the paper feeder decreases.

BRIEF DESCRIPTION OF THE DRAWINGS

FIGS. 1-20 are diagrams illustrating the present invention, wherein:

FIG. 1 is an exploded view in perspective of a paper feeder 20 according to the present invention;

FIG. 2 is an enlarged perspective view of a main frame 1 and a driving assembly 37;

FIGS. 3-6 are a plan view, a front elevation, a rear elevation and a right elevation, respectively, of the paper feeder according to the present invention;

FIGS. 7-10 are a plan view, a front elevation, a rear elevation and a right elevation, respectively, of a main frame 1;

FIGS. 11-13 are sectional views taken along the lines A—A, B—B and D—D, respectively, in FIG. 7;

FIG. 14 is a longitudinal section of the paper feeder 20 according to the present invention;

FIG. 15 is a horizontal section of the paper feeder, which is taken along the line passing the projections 15*a*, 15*b* on a sub-frame 4;

FIG. 16 is sectional view showing the driving assembly 37 which is being fitted in the main frame 1;

FIG. 17 is a sectional view of the paper feeder 20;

FIG. 18 is a perspective view of another main frame 1';

FIG. 19 is a sectional view of the portion of the main frame 1' where a spring fitting bore 16'*a* or 16'*b* is located; and FIG. 20 is a plan view showing the condition of perforated paper being fed.

FIGS. 21-23 are diagram illustrating a conventional paper feeder, wherein:

FIG. 21 is a sectional view of the portion of this paper feeder at which two frame members 51, 52 are combined with each other by a connecting bolt 53;

FIG. 22 is a front elevation showing the two frame members 51, 52 combined in a dislocated state; and FIG. 23 is a sectional view taken along the line E—E in FIG. 22.

DESCRIPTION OF THE PREFERRED EMBODIMENT

Figure 1:
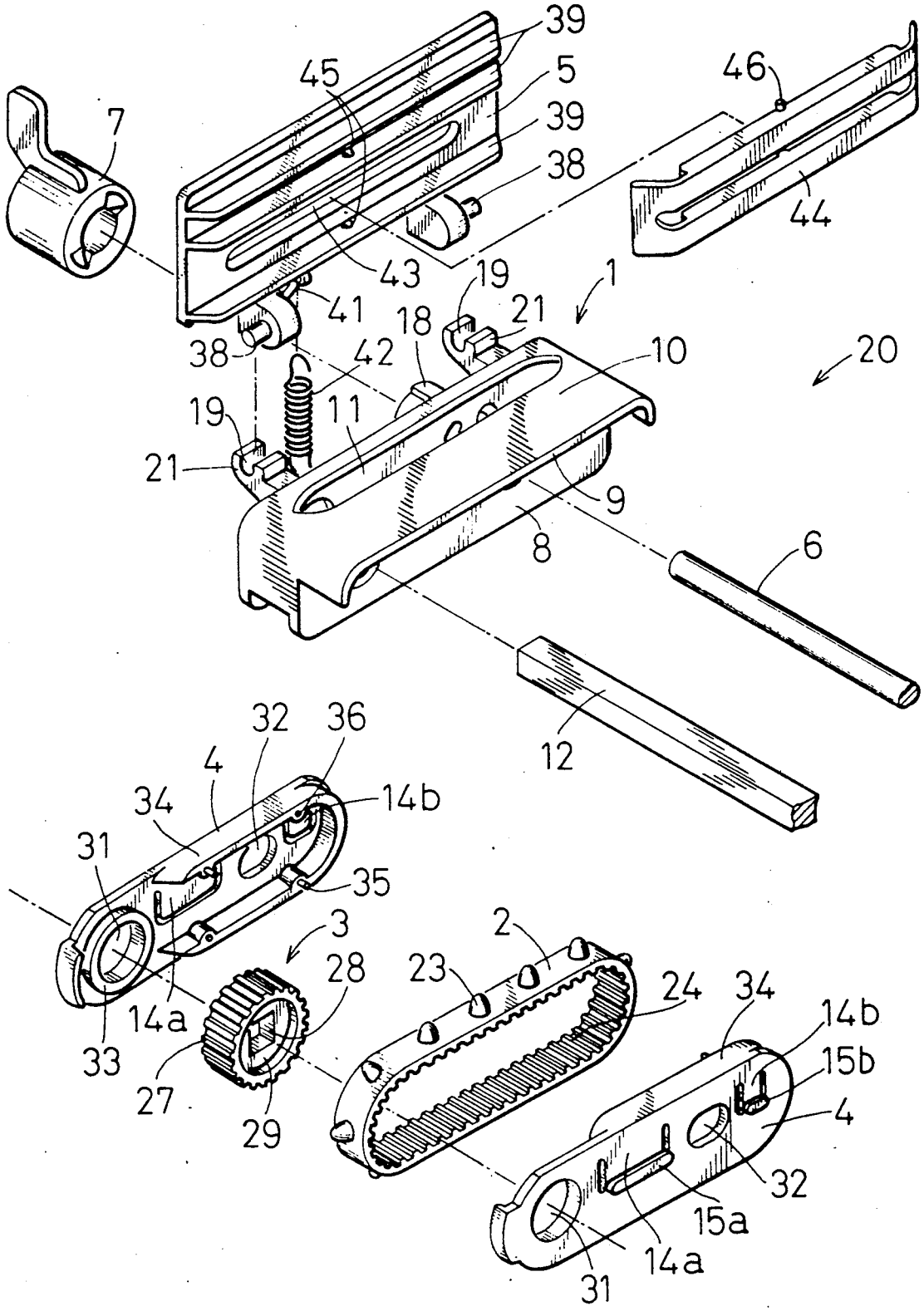

The present invention will now be described more in detail with reference to its embodiment.

AS shown in FIGS. 1-6, a paper feeder 20 according to the present invention consists of a main frame 1 of an integral structure, a feed belt 2, a driving sprocket 3 for use in driving this feed belt 2, a pair of sub-frames 4 to which the feed belt 2 and driving sprocket 3 which are combined in the form of sub-assembly are to be attached, a cover member 5 fixed to the upper surface of the main frame 1 so that the cover member 5 can be opened and closed, and a clamp 7 for use in fixing the paper feeder as a whole in a clamped state on a support shaft 6.

The main frame 1 of an integral structure is shown in FIGS. 2 and 7-13. This main frame 1 has at both side portions thereof a pair of side plates 8 formed in an opposed state so that they are spaced at a predetermined distance. A paper feed plate 9 is provided on the upper end portion of one side plate 8 so as to extend sideways, and the upper surface of this paper feed plate 9 constitutes a paper feed surface 10, which is provided with a feed belt moving bore 11 (refer to FIG. 12) having a width $W_2$ which is slightly larger than that $W_1$ (refer to FIG. 17) of the feed belt 2, this bore 11 extending in the direction in which perforated paper is fed. The main frame 1 thus has a hollow integral structure opened at its lower surface.

The opposite portions of the two opposed side plates 8 are provided with bores 13 used to receive a cross-sectionally square driving shaft 12 therethrough, and another opposite portions thereof elongated bores 16*a*, 16*b* in which the projections 15*a*, 15*b* provided on the plate spring members 14*a*, 14*b* of the sub-frames 4 are fitted. One side plate 8 is provided with a bore 17 used to receive support shaft 6 therethrough, while the portion of the other side plate 8 which corresponds to this bore 17 is provided with a two-split cylinder type clamp member 18 projecting outward therefrom. The second-mentioned side plate 8 is provided on its upper end portion with a pair of cover receiving members 21 having grooves 19 and spaced at a predetermined distance in the direction in which the perforated paper is fed. The lower end portion, which is below one cover receiving member 21, is provided with a spring arm 22 formed integrally therewith.

The endless feed belt 2 is formed out of a flexible resin, and provided on its outer circumferential surface with a plurality of feed pins 23 projecting outward and arranged at regular intervals, and in its inner circumferential surface with an internal gear 24 as shown in FIG. 1. The pitch of the feed pins 23 projecting from the outer circumferential surface of the feed belt 2 is equal (refer to FIGS. 20) to that of the perforations 26 formed in both edge portions of the perforated paper 25.

Figure 15:
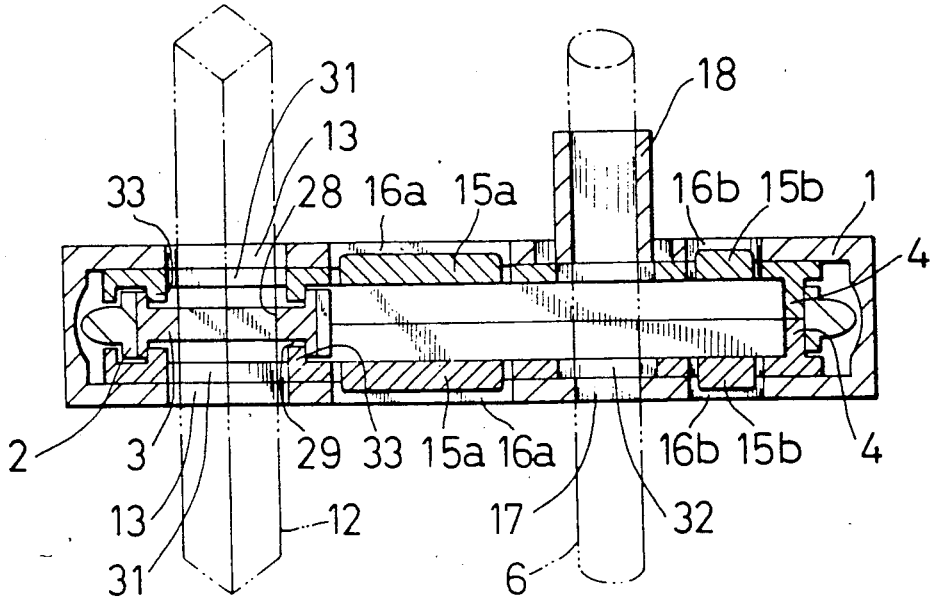

As shown in FIGS. 1 and 15, the driving sprocket 3 is provided on its outer circumferential surface with an external gear 27 the width of which is substantially equal to that $W_1$ of the feed belt 2, and in its central portion with a square shaft inserting bore 28, circular engagement recesses 29 being provided in both side surfaces of the same sprocket 3.

The two plate type sub-frames 4 have a symmetric shape as shown in FIG. 1, and are provided with driving shaft inserting bores 31 and support shaft inserting bores 32. The sub-frames 4 are further provided with plate spring members 14*a*, 14*b* which are formed by making narrow bores 30 therearound, projections 15*a*, 15*b* being provided on the lower end portions of the outer surfaces of these plate spring members 14*a*, 14*b*.

The inner surfaces of the sub-frames 4 are provided thereon with engagement projections 33, which are adapted to be fitted in the engagement recesses 29 in the driving sprocket 3 and support the same sprocket 3, and belt receiving members 34 adapted to receive the feed belt 2 passed therearound. The two sub-frames 4 are joined to each other unitarily by using pins 35 and pin holes 36 provided on and in the end surfaces of the belt receiving members 34.

Figure 2:
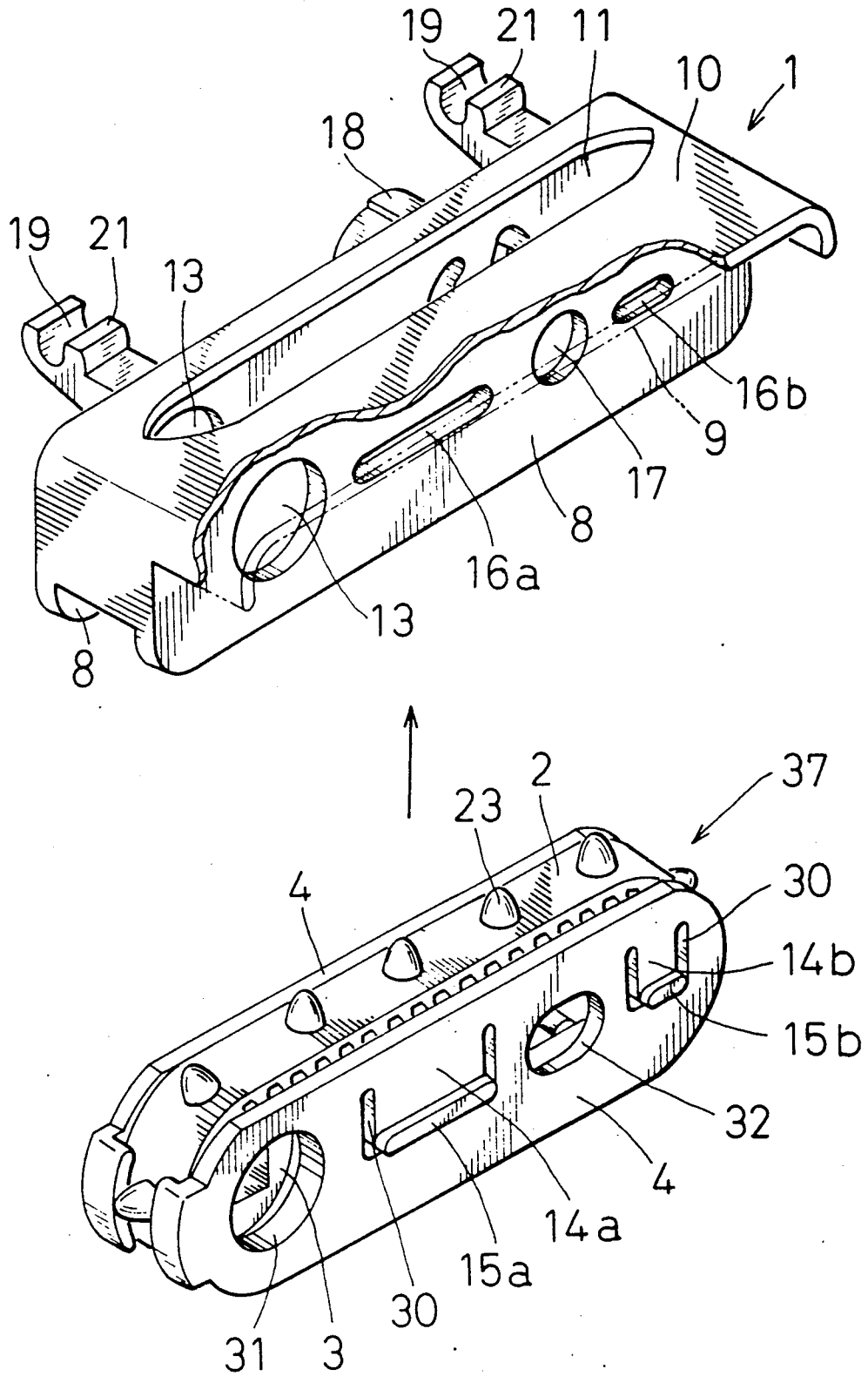
Figure 3:
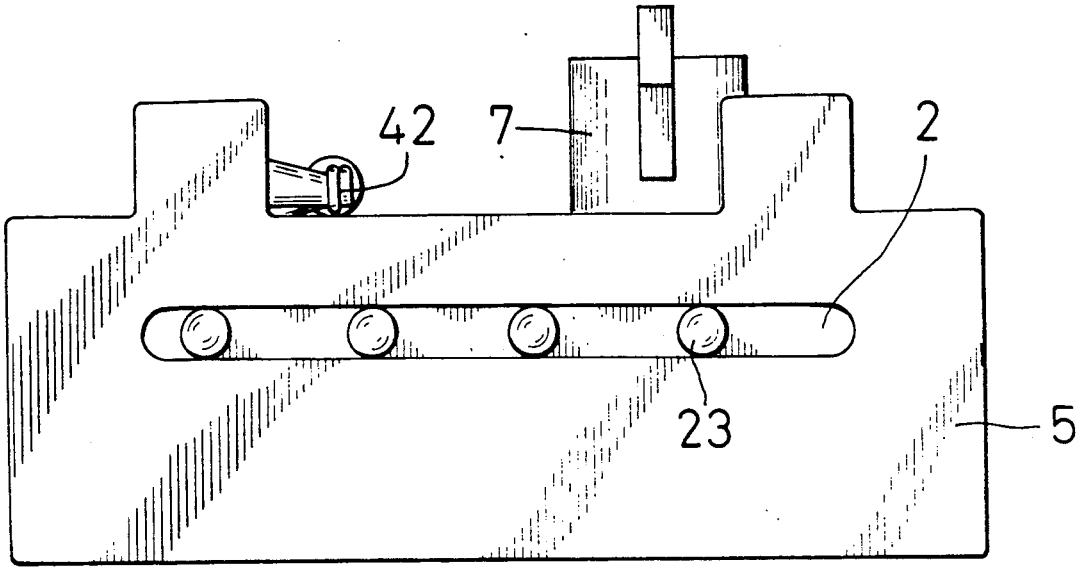
Figure 4:
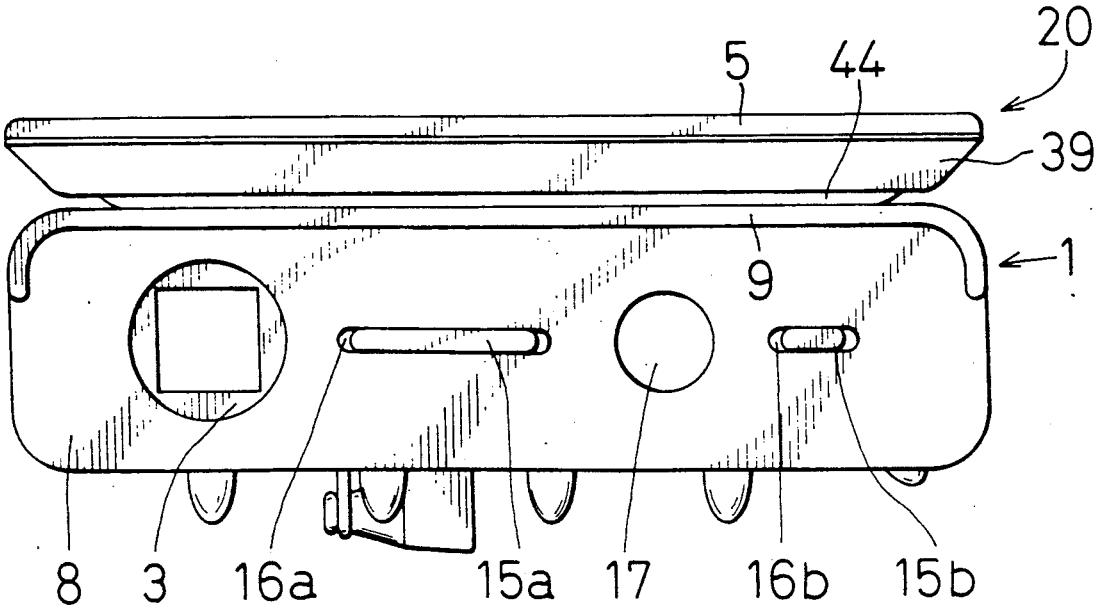
Figure 5:
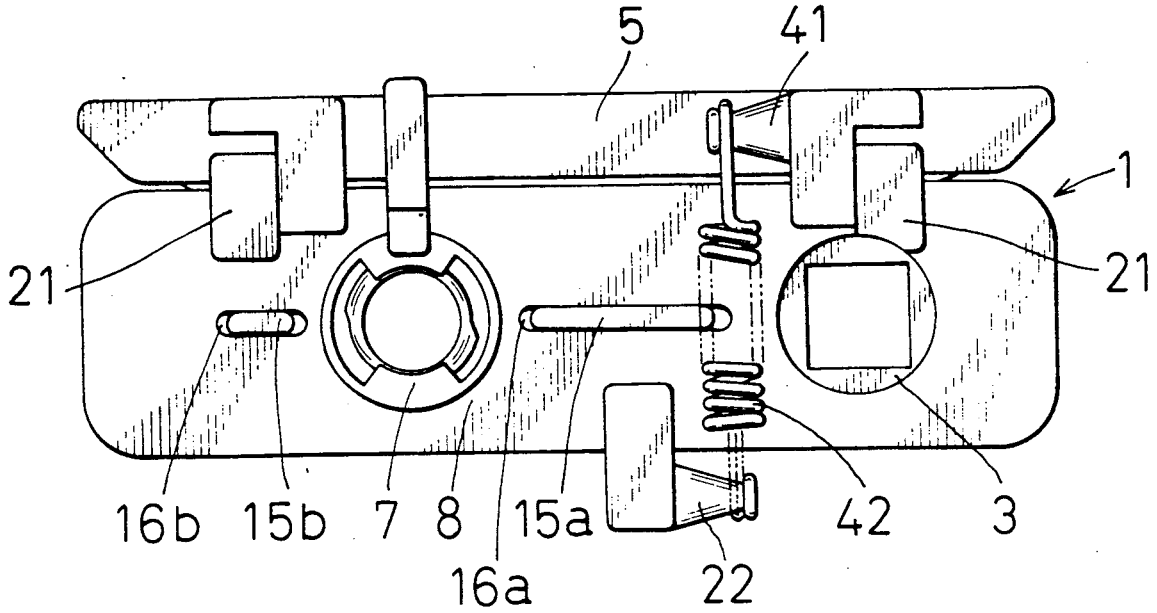
Figure 6:
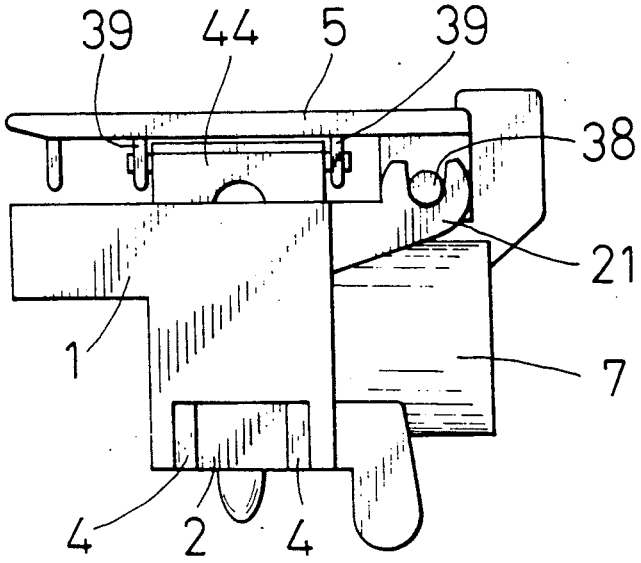
Figure 7:
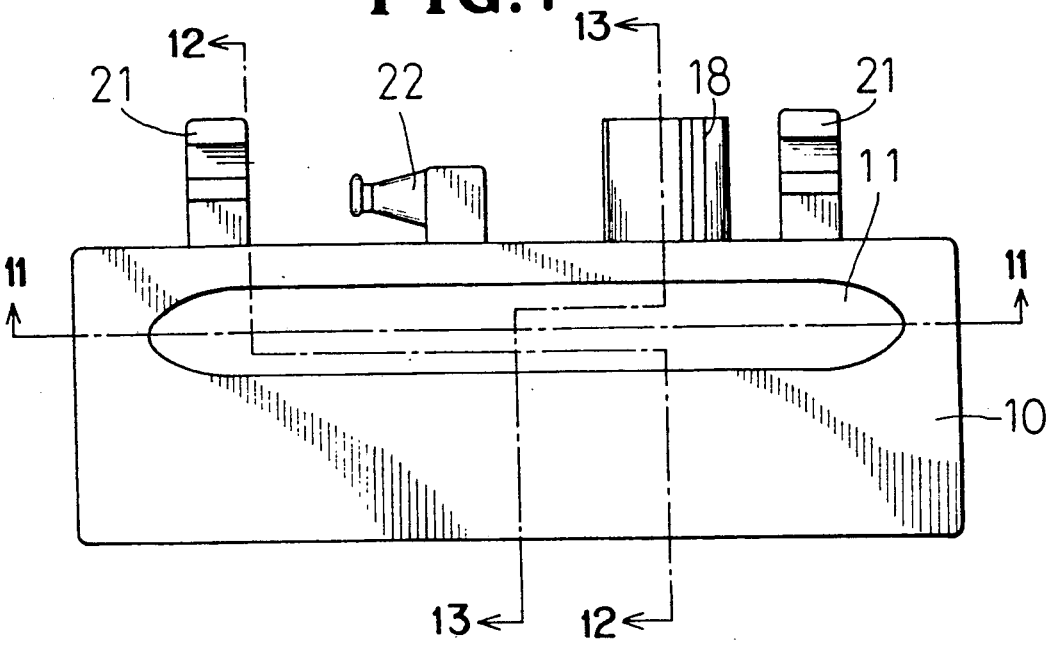
Figure 8:
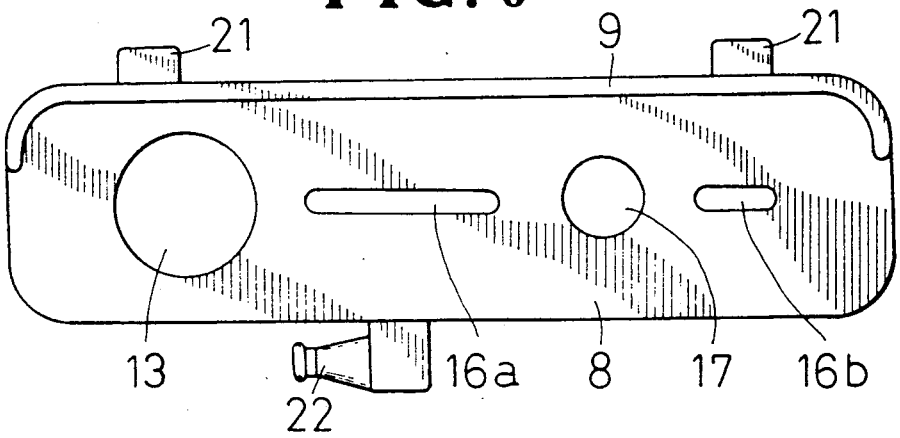
Figure 9:
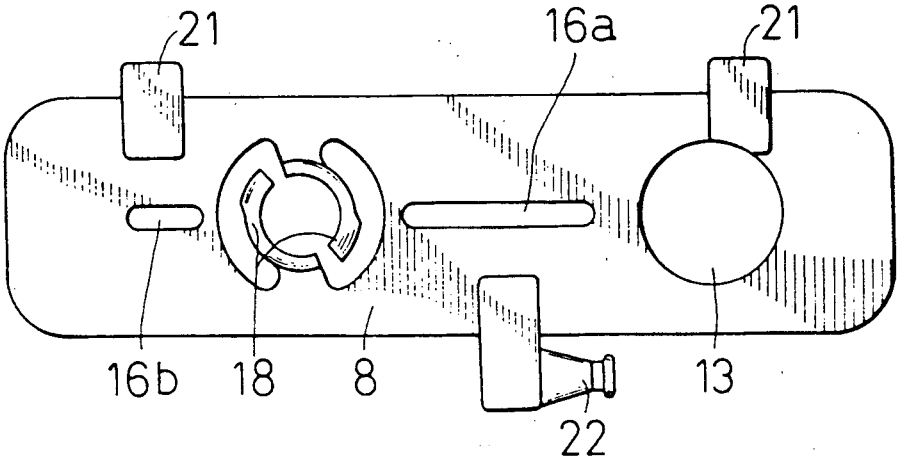
Figure 10:
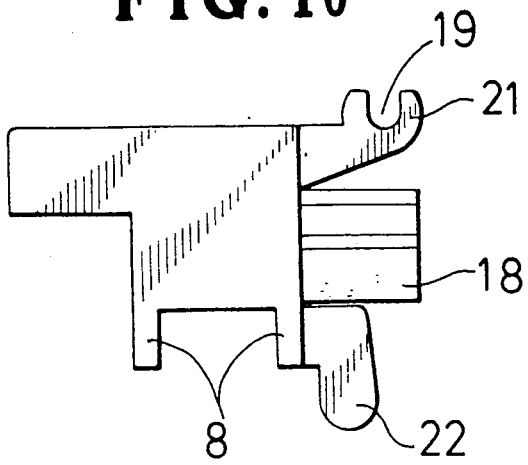
Figure 11:
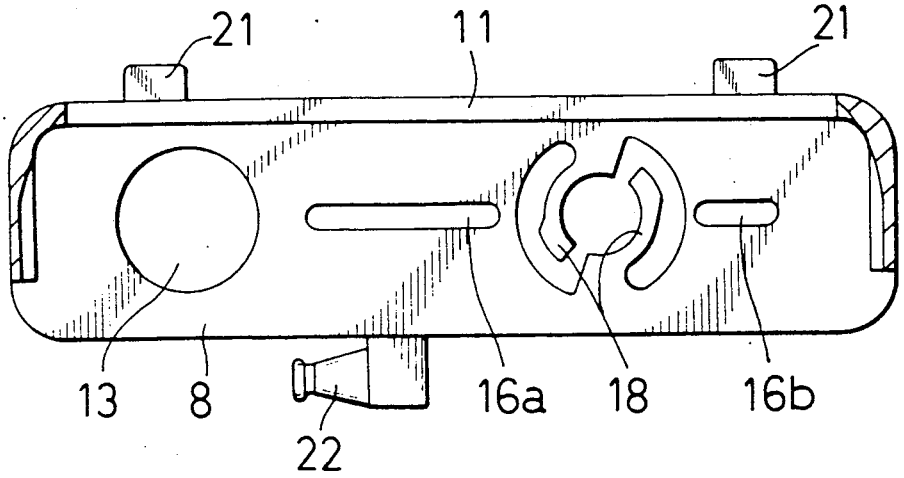
Figure 12:
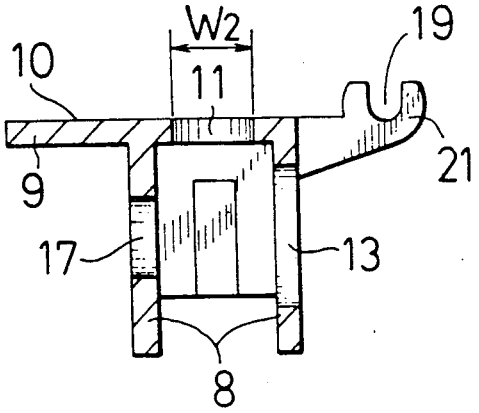
Figure 13:
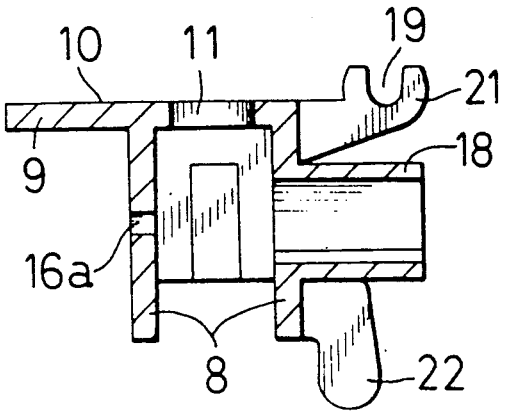

As shown in FIGS. 2 and 15, the engagement projections 33 formed on the inner surfaces of the two sub-frames 4 are fitted in the engagement recesses 29 formed in both side surfaces of the driving sprocket 3, and the feed belt 2 is passed around this driving sprocket 3 and the belt receiving members 34 of the unitarily combined sub-frames 4. Consequently, the feed belt 2 and driving sprocket 3 are combined by the two sub-frames 4 to form a driving assembly 37.

The cover member 5 is provided with a pair of fulcrum shafts 38 extending in the direction in which the perforated paper is fed. The inner surface of the cover member 5 is provided with a plurality of guide ribs 39 extending in the direction in which the paper is fed. When the fulcrum shafts 38 provided on the cover member 5 are fitted in the grooves 19 provided in the cover receiving members 21 of the main frame 1 with a tension spring 42 hooked on a spring arm 41, which is provided on the cover member 5, and a spring arm 22, which is provided on the main frame 1, the cover member 5 is fixed to the main frame 1 so that the cover member 5 can be opened and closed. The portion of the cover member 5 which is opposed to the belt moving bore 11 when the cover member 5 is set on the main frame 1 is provided with an elongated bore 43 used to observe the moving condition of the feed belt 2 therethrough.

A paper holding plate 44 for preventing the perforated paper 25 from floating during the feeding of the paper is fixed to the inner surface of the cover member 5. As shown in FIG. 1, the guide ribs 39 formed on the inner surface of the cover 5 is provided with locking bores 45 at their longitudinally intermediate portions, while the paper holding plate 44 is provided with locking pins 46 on both of its side surfaces, the paper holding plate 44 being fixed to the inner surface of the cover member 5 by fitting the locking pins 46 on the former in the locking bores 45 in the latter.

Figure 16:
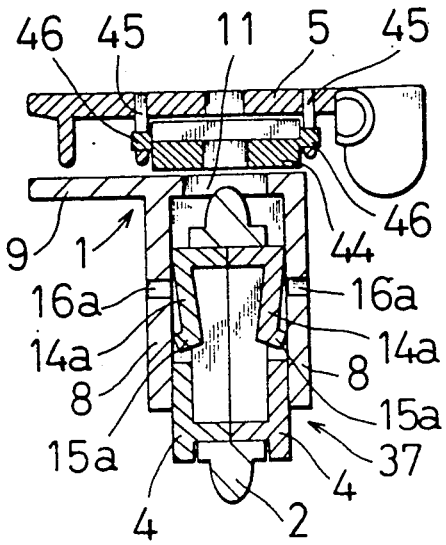
Figure 17:
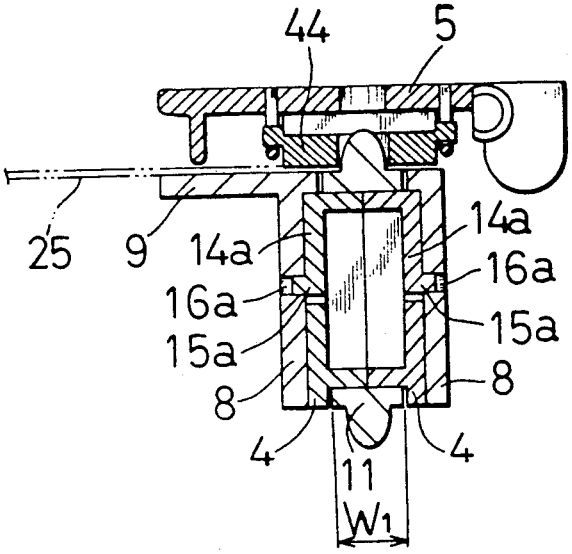

When the driving assembly 37 in which the feed belt 2 and driving sprocket 3 are combined by a pair of sub-frames 4 as shown in FIG. 2 is forcibly inserted from the opening at the lower side of the main frame 1 into the space between the both side plates 8, the plate spring members 14*a*, 14*b* provided on the sub-frames 4 are elastically deformed as shown in FIG. 16, and the projections 15*a*, 15*b* provided at the lower end portions of these plate spring members 14*a*, 14*b* engage the locking bores 16*a*, 16*b* provided in the side plates 8. Consequently, the sub-frames 4 are fixed to the inner side surfaces of the side plates 8 of the main frame 1 with the driving assembly 37 fitted firmly between the same side plates 8, and the portion of the feed belt 2 which is on the side of the perforated paper being fed fits into the feed belt moving bore 11 provided in the main frame 1 and is aligned with the paper feed surface 10 of the main frame 1 with the feed pins 23 on the feed belt 2 projecting from the same paper feed surface 10, as shown in FIGS. 14, 15 and 17.

Figure 14:
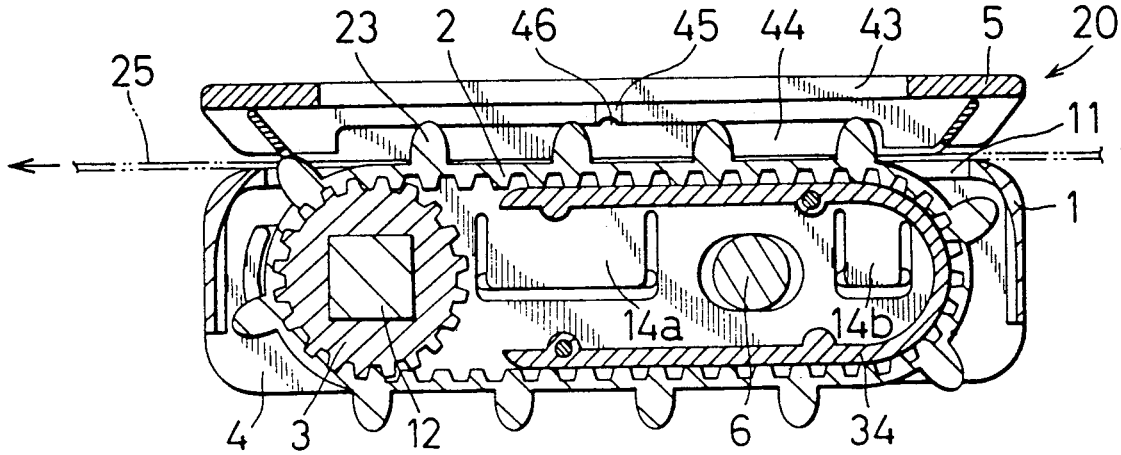
Figure 20:
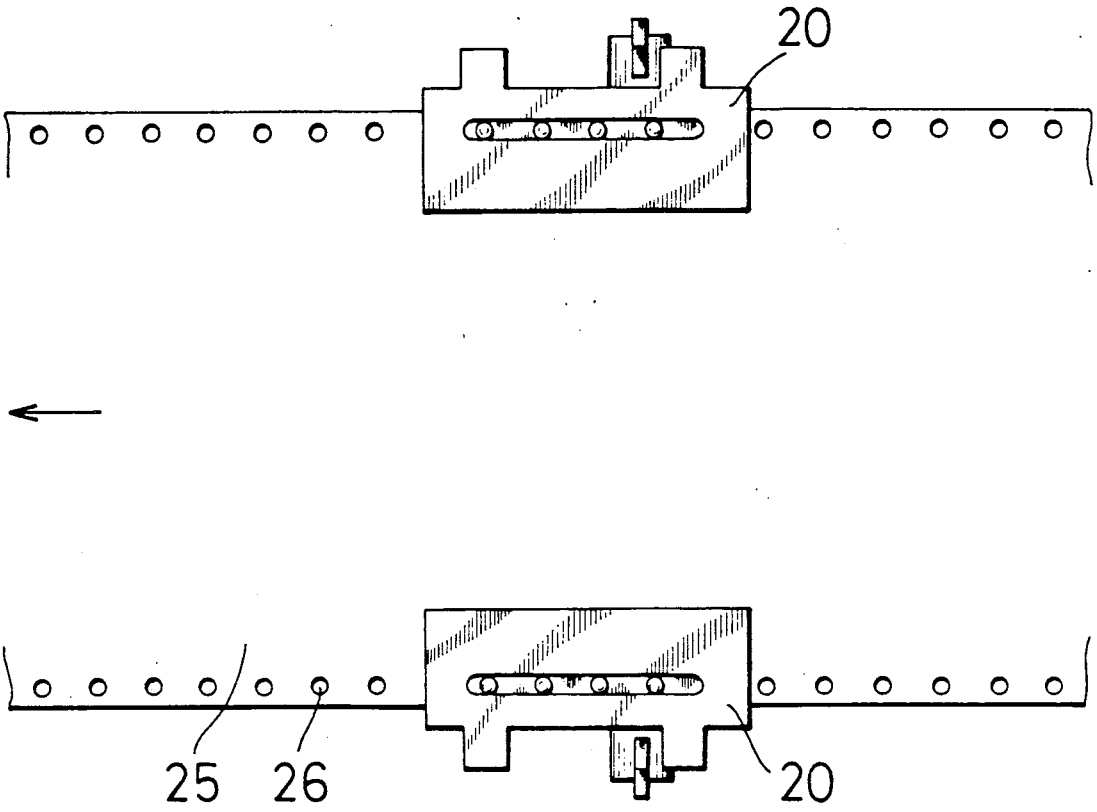
Figure 21:
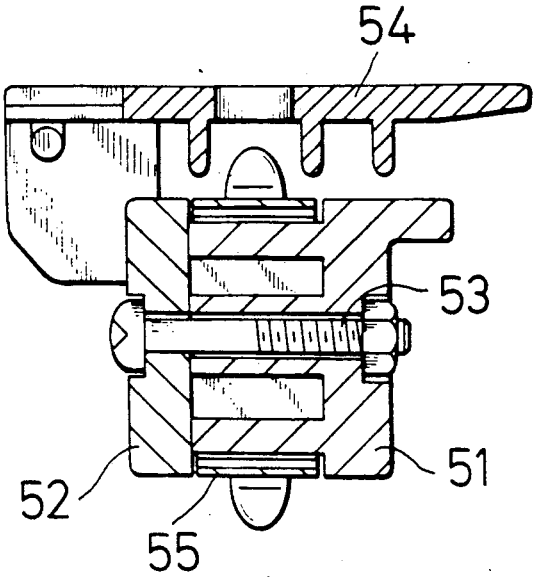
Figure 22:
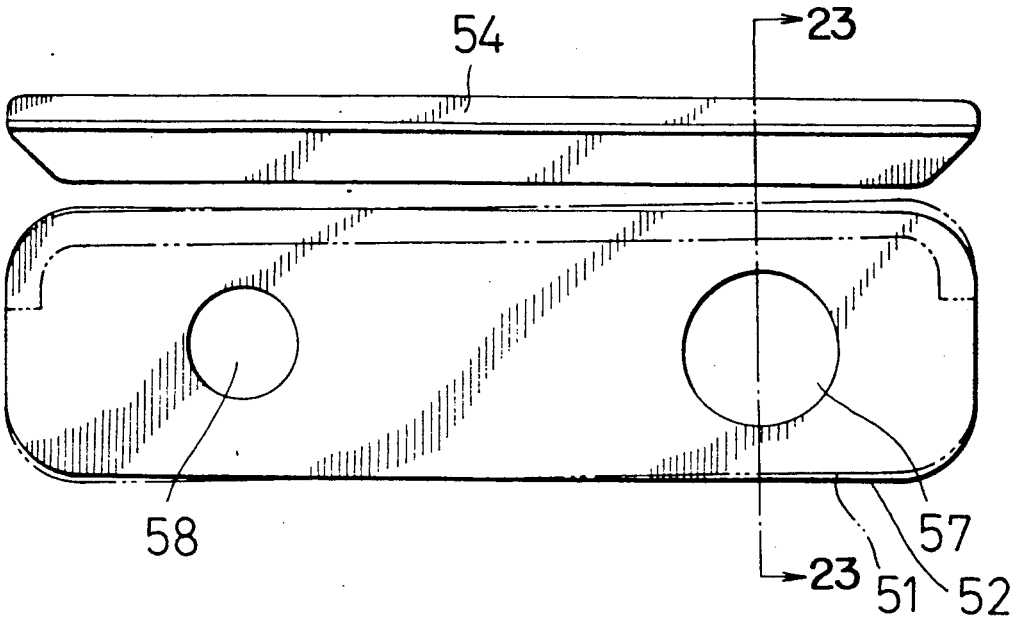
Figure 23:
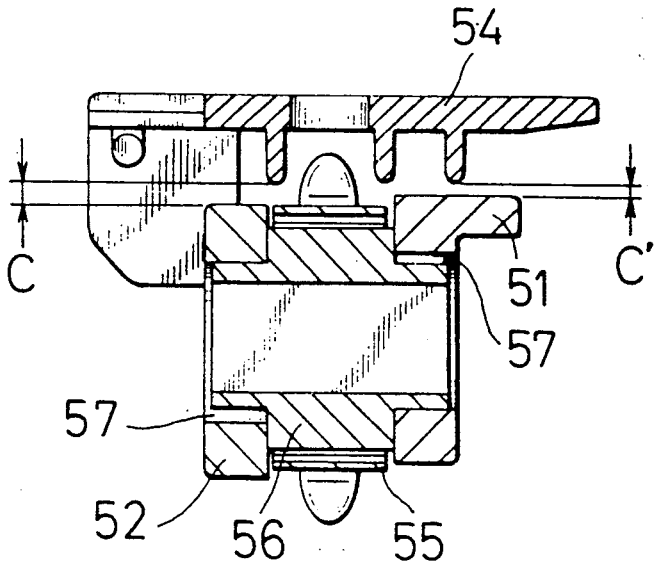

As shown in FIGS. 14, 15 and 20, the driving shaft 12 is fitted in the bore 28 in the driving sprocket 3, and the support shaft 6 is inserted through the bores 17, 32 in the main frame 1 and sub-frame 4, to determine the distance between a pair of paper feeders 20, the clamp members 18 which are provided on the main frame 1 being then tightened around the support shaft 6 by the clamp 7. As a result, the paper feeder 20 is fixed on the support shaft 6.

When the feed belt 2 is moved by the driving sprocket 3, the perforated paper 25 in which the feed pins 23 are engaged with the perforations 26 in both edge portions thereof is fed in a floating-prevented state as the paper 25 is pressed lightly against the paper feed surface 10 of the main frame 1 by the paper holding plate 44 fixed to the inner surface of the cover member 5.

The main frame 1 is integrally formed, and the width $W_2$ of the feed belt moving bore 11 is kept constant independent of assembling conditions. Therefore, the holding of the feed belt between the two side plates or the loosening of the feed belt, both of which are ascribed to a decrease in the frame combining accuracy encountered in a conventional paper feeder having a frame of a combined structure, does not occur, so that the accuracy of feeding the perforated paper 25 is improved. Since the main frame 1 has an integral structure, the paper feed surface 10 constituting the upper surface thereof retains the same horizontal level, and the vertical distance of the clearance between the paper feed surface 10 and cover member 5 is constant over the whole of the paper feed surface 10, so that the paper feed accuracy is improved.

Owing to the integral construction of the main frame 1, the axes of the support shaft inserting bores 17 formed in both side plates 8 does not go out of alignment. Accordingly, the paper feeder 20 can be clamped without troubles on the support shaft 6 by the clamp 7, and it can be moved smoothly in the lateral direction along the support shaft 6. Moreover, the clamping of the paper feeder 20 can be done on a proper position on the support shaft 6 without causing the tilting of the paper feeder 20.

In addition, the feeder belt 2 and driving sprocket 3 are attached in the form of a sub-assembly to a pair of sub-frames 4, and the length of the projections 15*a*, 15*b* provided in the sub-frames 4 is set smaller than that of the locking bores 16*a*, 16*b* formed in the side plates 8 of the main frame 1. Accordingly, the driving assembly 37 as a whole, which consists of a combination of the feed belt 2 and driving sprocket 3, and a pair of sub-frames 4 to which this combination is attached, and which is fitted firmly in the main frame 1, can be finely moved in the direction in which the perforated paper is fed. Since the driving assembly 37 can be finely moved with respect to the main frame 1 in the direction in which the perforated paper is fed, and correspondingly to the distance between the axes of the support shaft 6 and driving shaft 12, the rotational resistance of the driving sprocket 3 does not increase even when the distance between the axes of the support shaft 6 and driving shaft 12 is different from a proper level. This enables the driving sprocket 3 to be rotated with a predetermined level of torque.

Figure 18:
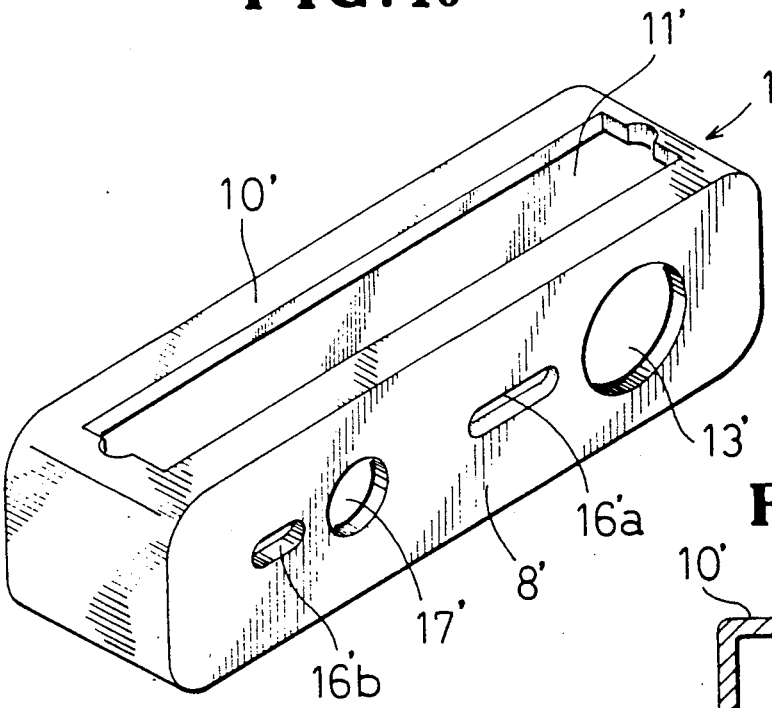
Figure 19:
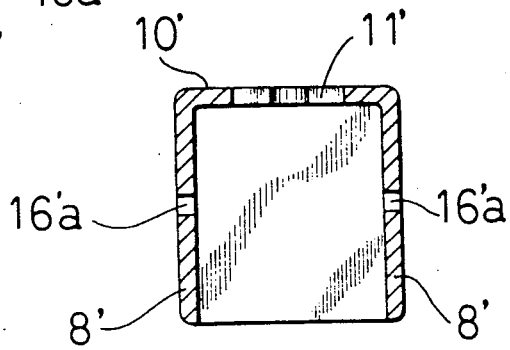

Another integrally formed main frame 1' is shown in FIGS. 18 and 19, and the parts of this main frame 1' which are equivalent to those of the above-described main frame 1 are designated by the same reference numerals with a dash put after each thereof.

What is claimed is:

1. An integral frame type paper feeder constructed so that perforated paper is fed by moving a feed belt, which is set in a main frame, by a driving sprocket with feed pins on said feed belt fitted in the perforations in said perforated paper, comprising a pair of sub-frames for use in assembling said feed belt and said driving sprocket with each other in the form of a sub-assembly; and a main frame of an integral structure consisting of a pair of side plates which are formed in an opposed state at both side portions thereof so as to be spaced from each other at a predetermined distance, and which are used to fix said sub-frames thereto, and an upper plate the upper surface of which constitutes a paper feed surface, which upper plate is provided with a feed belt moving bore which is formed so as to extend in the direction in which said perforated paper is fed, and which allows the portion of said feed belt on which said perforated paper is being fed to be aligned with said paper feed surface, a driving assembly, which consists of said two sub-frames, and said feed belt and said driving sprocket, which are combined with said sub-frames, being fitted between the side plates of the main frame, said sub-frames being fixed to said side plates.

2. An integral frame type paper feeder according to claim 1, wherein said driving assembly fitted firmly between said side plates of said main frame is set capable of being slightly moved in the direction in which said perforated paper is fed.

* * * * *